US011207889B2

(12) United States Patent
Kitayama et al.

(10) Patent No.: US 11,207,889 B2
(45) Date of Patent: Dec. 28, 2021

(54) INKJET PRINT HEAD

(71) Applicant: CANON KABUSHIKI KAISHA, Tokyo (JP)

(72) Inventors: Yasuaki Kitayama, Yokohama (JP); Kyosuke Toda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/810,240

(22) Filed: Mar. 5, 2020

(65) Prior Publication Data

US 2020/0290353 A1 Sep. 17, 2020

(30) Foreign Application Priority Data

Mar. 15, 2019 (JP) ..... JP2019-048526

(51) Int. Cl.
*B41J 2/14* (2006.01)
*B41J 2/16* (2006.01)

(52) U.S. Cl.
CPC ..... *B41J 2/1433* (2013.01)

(58) Field of Classification Search
CPC ..... B41J 2/1433; B41J 2/1623; B41J 2/14016
See application file for complete search history.

(56) References Cited

U.S. PATENT DOCUMENTS

2012/0229572 A1* 9/2012 Miyazaki ..... B41J 2/14024 347/50
2016/0059551 A1* 3/2016 Miyazaki ..... B41J 2/14145 347/57

FOREIGN PATENT DOCUMENTS

JP 2009-143014 A 7/2009

* cited by examiner

*Primary Examiner* — Jason S Uhlenhake
(74) *Attorney, Agent, or Firm* — Canon U.S.A., Inc. I.P. Division

(57) ABSTRACT

An inkjet print head includes a print element substrate having an ejection port array of a plurality of ejection ports arranged and an ink supply port that supplies the ink to the ejection ports. A support member has a partition and an opening that supplies the ink to the ink supply port, in which the print element substrate and the support member are bonded by an adhesive. The partition includes a first portion and a second portion. The second portion is located between individual extension lines of two surfaces of the first portion. An end of the surface of the print element substrate facing the second portion is located between an extension line of the surface of the first portion and an extension line of a surface of the second portion.

13 Claims, 9 Drawing Sheets

INKJET PRINT HEAD

BACKGROUND OF THE DISCLOSURE

Field of the Disclosure

The present disclosure relates to an inkjet print head.

Description of the Related Art

When a print element substrate that ejects ink droplets is fixed with a support member for supporting the print element substrate by using an adhesive, the adhesive sometimes protrudes onto an ink supply port of the print element substrate. Protrusion of the adhesive onto the ink supply port might cause the protruding adhesive to block a part of the ink supply port and hinder ink supply. To cope with this, Japanese Patent Laid-Open No. 2009-143014 discloses a configuration that provides a step in the support member to hold the adhesive used for fixing the print element substrate with the support member at the step, thereby suppressing protrusion of the adhesive onto the ink supply port.

With the configuration of Japanese Patent Laid-Open No. 2009-143014, the adhesive hardly flows to the print element substrate side, and this limits the adhesion surface area between the adhesive and the print element substrate, making it difficult to ensure sufficient adhesive strength.

SUMMARY OF THE DISCLOSURE

In view of the above problem, the present disclosure aims to provide an inkjet print head capable of ensuring sufficient adhesive strength while suppressing protrusion of an adhesive used for fixing a print element substrate and a support member onto an ink supply port.

In order to solve the above-described problem, the present disclosure provides an inkjet print head including: a print element substrate having an ejection port array of a plurality of ejection ports arranged for ejecting ink and an ink supply port extending along the ejection port array to supply the ink to the ejection ports; and a support member having a partition to support the print element substrate and an opening formed between two adjacent partitions for supplying the ink to the ink supply port, in which the print element substrate and the support member are bonded to each other by an adhesive between the print element substrate and the partition, the partition includes a first portion, and a second portion connected to the first portion and formed at a position on a side closer to the print element substrate than the first portion, the second portion is located between individual extension lines of two surfaces of the first portion facing the opening on a cross section orthogonal to a direction in which the ink supply port of the print element substrate extends, and an end of the surface of the print element substrate facing the second portion is located between an extension line of the surface of the first portion facing the opening and an extension line of a surface of the second portion facing the opening on a side having the extension line of the surface of the first portion, on a cross section orthogonal to the direction in which the ink supply port of the print element substrate extends.

Further features and aspects of the present disclosure will become apparent from the following description of exemplary embodiments (with reference to the attached drawings).

DESCRIPTION OF THE EMBODIMENTS

Hereinafter, numerous embodiments, features and aspects of the present disclosure will be described in detail.

First Example Embodiment

Example Inkjet Print Head

Figure 1:
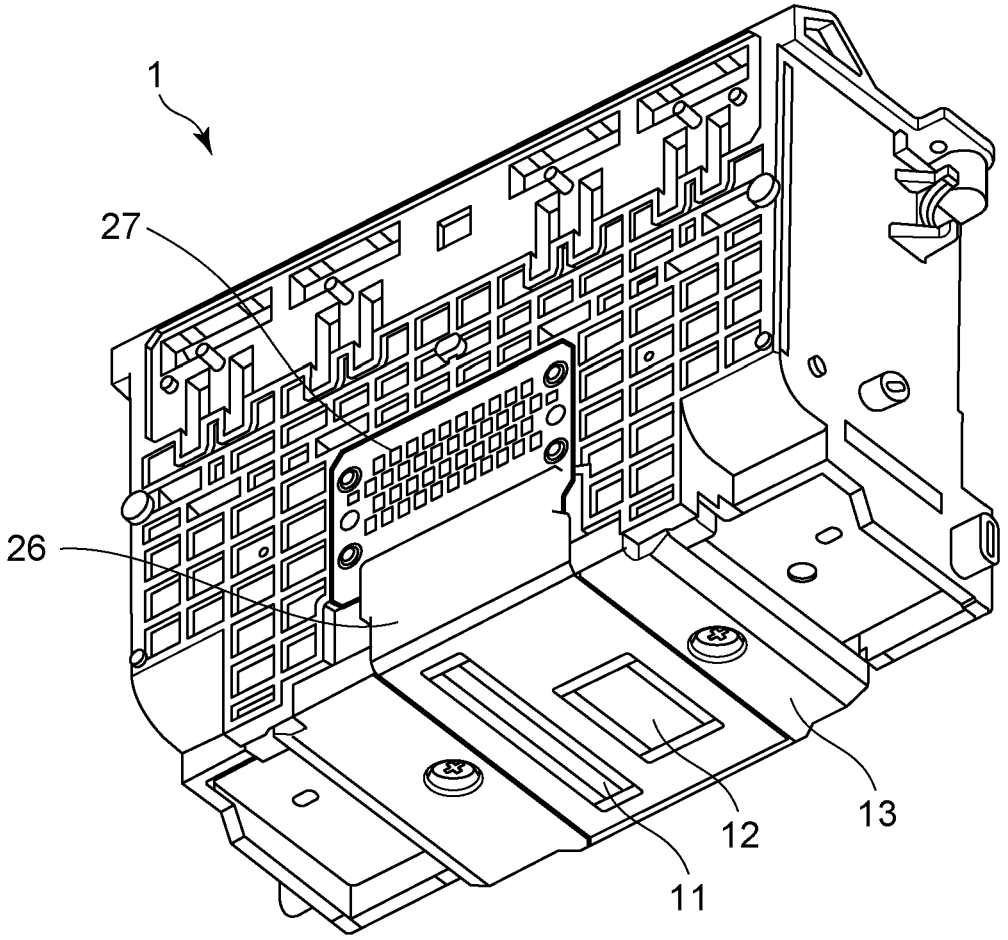
FIG. 1 is a perspective view illustrating an example inkjet print head.

An inkjet print head according to the present embodiment will be described with reference to FIG. 1. FIG. 1 is a perspective view illustrating an inkjet print head 1 according to the present embodiment. Print element substrates 11 and 12 that eject ink are electrically connected to a flexible wiring substrate 26 in order to supply the electric power for driving a heater in the print element substrate to the print element substrates 11 and 12. The flexible wiring substrate 26 is electrically connected to an electric wiring board 27 that is electrically connected to a printing apparatus body on which the inkjet print head 1 is mounted. An ink tank that contains ink is mounted on an ink tank storage portion of the inkjet print head 1.

Example Print Element Substrate and Support Member

Figure 2A:
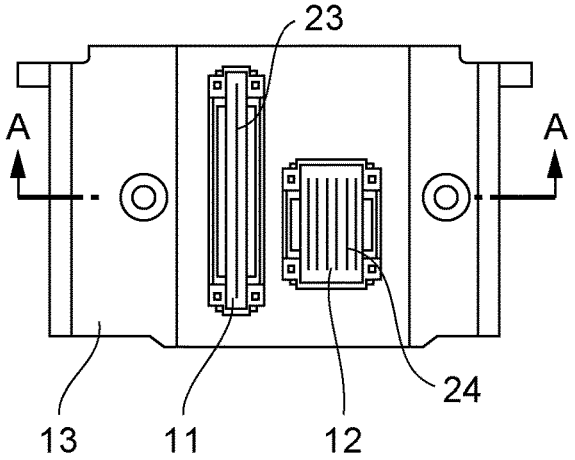
FIGS. 2A to 2D are perspective views illustrating an example print element substrate and a support member.
Figure 2C:
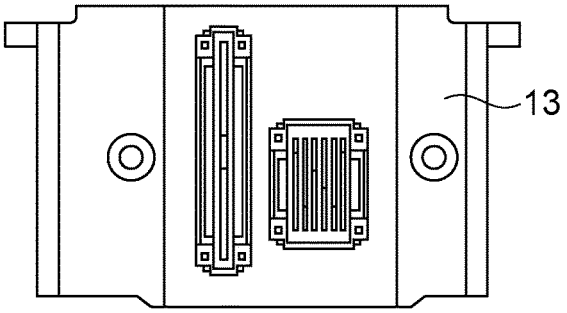
Figure 2B:
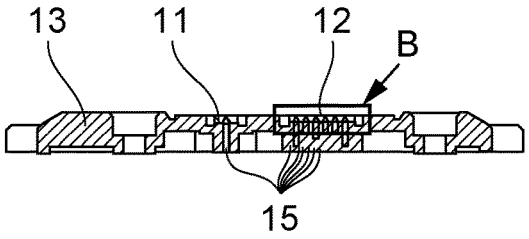
Figure 2D:
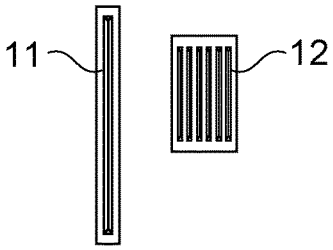

A print element substrate and a support member will be described with reference to FIGS. 2A to 4C. FIGS. 2A to 2D illustrate a print element substrate and a support member according to the present embodiment. FIG. 2A is a plan view of a state where the print element substrates 11 and 12 and a support member 13 are joined. FIG. 2B is a cross-sectional view taken along line A-A illustrated in FIG. 2A. FIG. 2C is a plan view of a joint surface side of the support member 13 to be joined to the print element substrates 11 and 12. FIG. 2D is a plan view of the joint surface side to be joined to the support members of the print element substrates 11 and 12. The print element substrates 11 and 12 are bonded with the support member 13 by an adhesive 14 as illustrated in FIGS. 3A and 3B.

The print element substrates 11 and 12 respectively include ejection port arrays 23 and 24 each having a plurality of ejection ports arranged for ejecting ink. The print element substrate 11 for black (BK) ink includes one ink supply port 15 for supplying ink to the ejection port, while the print element substrate 12 for color (CL) ink includes a plurality of the ink supply ports 15, specifically, six ports in FIGS. 2A to 2D. The ink supply port 15 extends along the ejection port array 24. Further, since the print element substrate 12 for CL ink ejects a plurality of types of ink, the adjacent ink supply ports 15 are basically formed independently.

Figure 3A:
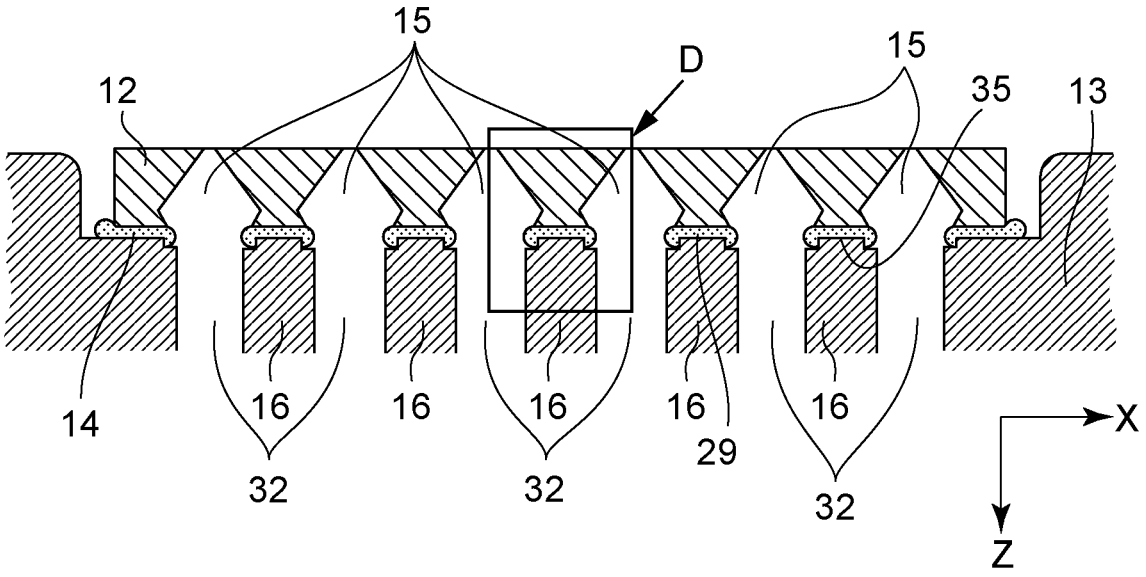
FIGS. 3A and 3B are enlarged views of a region indicated by B of FIG. 2B.
Figure 3B:
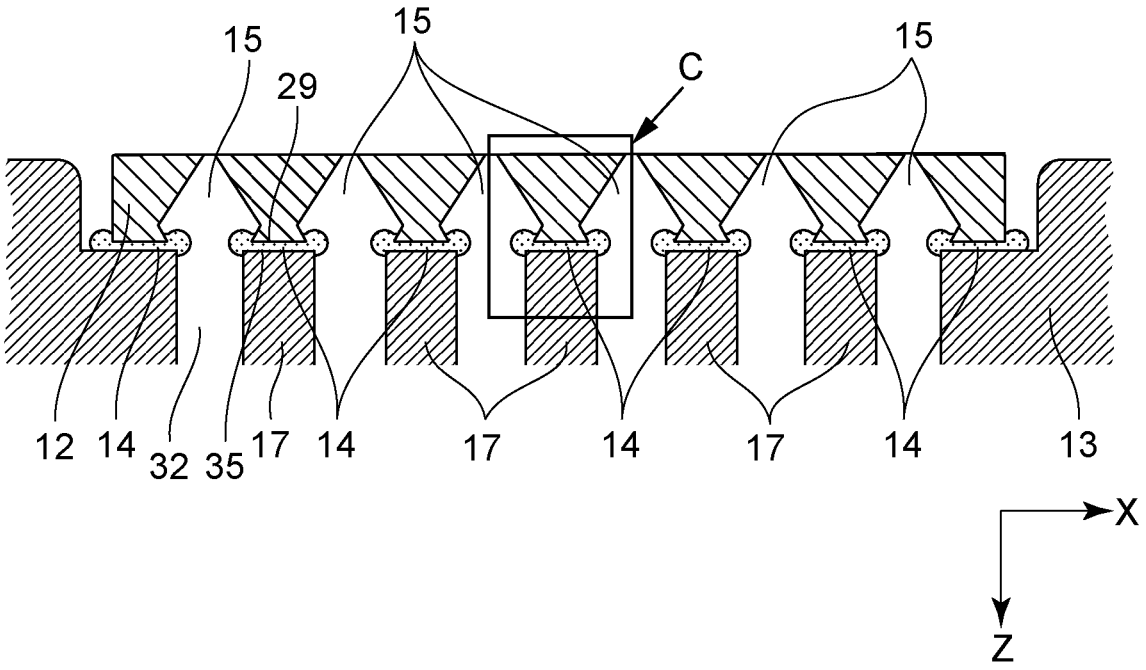

FIG. 3A is an enlarged view of a region illustrated in B of FIG. 2B, that is, a schematic view of a cross section orthogonal to a direction in which the ink supply port 15 extends. FIG. 3B is a view illustrating a comparative example of the present disclosure. Hereinafter, description will be given focusing on the adhesion between the print element substrate 12 for CL ink and the support member 13. The support member 13 includes a partition 16, with an opening 32 for supplying ink to the ink supply port 15 being provided between the partitions 16. In FIGS. 3A and 3B, the arrangement intervals of the ink supply port 15 and the opening 32 are both 1.25 mm. The opening 32 has a rectangular shape of 0.63 mm×11.5 mm, with a width of 0.63 mm in the x direction. In FIG. 3B, the adhesive 14 protrudes greatly onto the ink supply port 15, and this partially blocks the passage of the ink supply port 15. In contrast, as will be described in detail below, the protrusion of the adhesive 14 onto the ink supply port 15 is smaller in FIG. 3A.

When the print element substrate 12 and the support member 13 are bonded to each other, the adhesive 14 is applied to an adhesive surface 35 of the partition 16 of the support member 13, and then the adhesive 14 is crushed by an adhesive surface 29 of the print element substrate 12 so as to be cured to be fixed by a method such as heating. At this time, the adhesive 14 crushed on the adhesive surface 29 of the print element substrate 12 has substantially no increase or decrease in the volume from the shape before being crushed. A part of the adhesive 14 remains between the adhesive surface 29 and the adhesive surface 35 (hereinafter referred to as a bonding layer) and another part of the adhesive 14 protrudes onto both sides of the joint surface. That is, (volume of adhesive 14 in protrusion)≈(application volume of adhesive 14)−(volume of bonding layer). Protrusion of the adhesive 14 onto the ink supply port 15 would lead to the hindrance of ink supply that might cause unstable ejection of ink, or might even disable the ejection.

Figures 0, 4A:
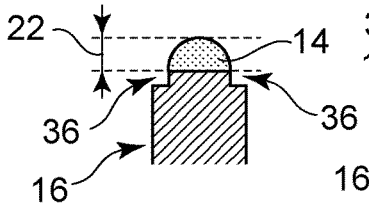
FIGS. 4A-0 to 4C are enlarged views of an example bonding portion between a partition and a print element substrate.
Figures 1, 4A:
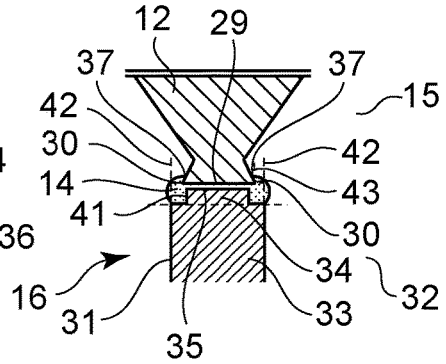
Figures 2, 4A:
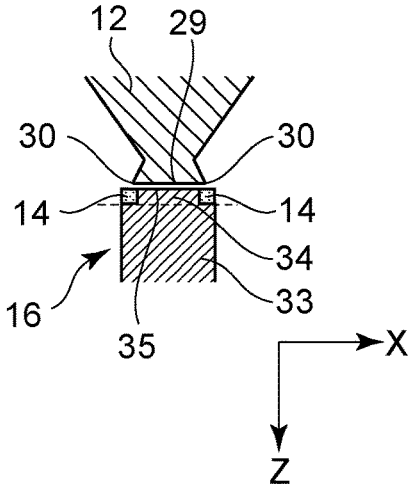
Figures 0, 4B:
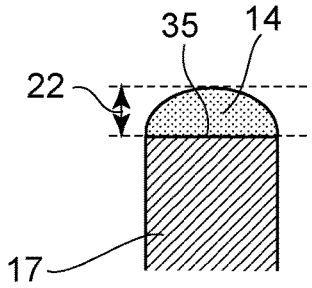
Figures 1, 4B:
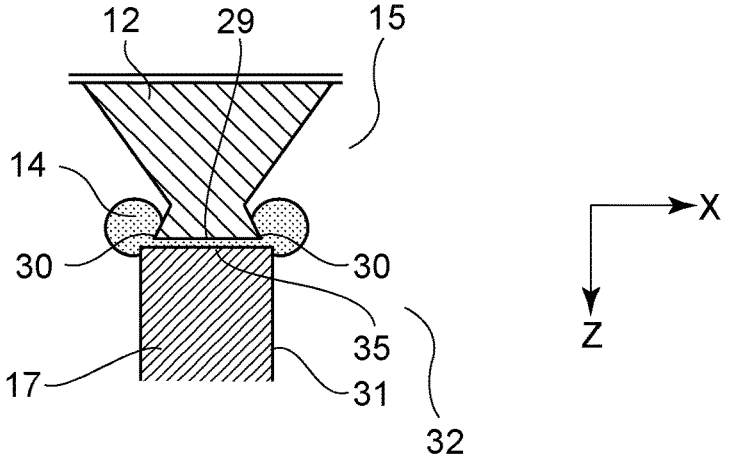
Figure 4C:
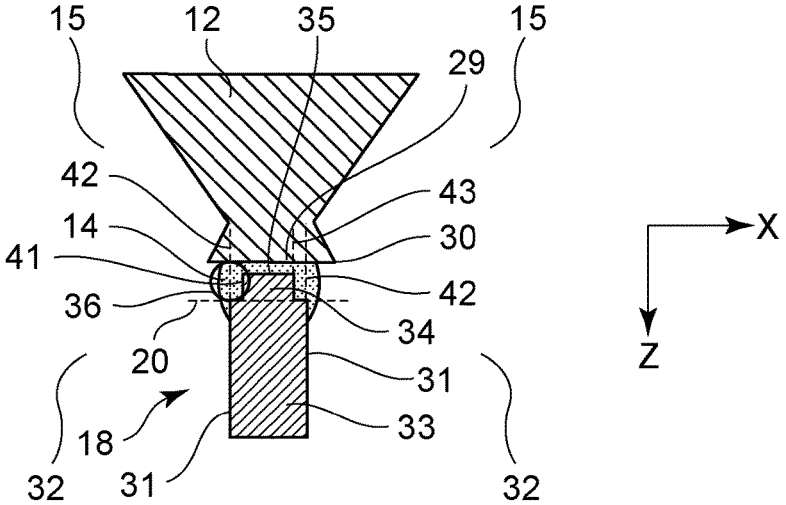

Next, a bonding region between the print element substrate 12 and the partitions of the support member 13 will be described in detail with reference to FIGS. 4A-0 to 4C. FIGS. 4A-0 to 4A-2 are enlarged views of part D of FIG. 3A according to the present embodiment. FIGS. 4B-0 and 4B-1 are enlarged views of part C of FIG. 3B, that is, a view illustrating a comparative example of the present embodiment. FIG. 4C is a view illustrating another comparative example of the present embodiment. FIGS. 4A-0 and 4B-0 are views of a state where the adhesive 14 is applied to the partition 16. FIGS. 4A-1, 4B-1, and 4C are schematic views illustrating a state of protrusion of the adhesive 14 when the adhesive 14 is crushed by the print element substrate 12. Note that the amount of the adhesive 14 in FIGS. 4A-0 to 4C is determined in consideration of the required application height 22 described below.

In the comparative example illustrated in FIG. 4B-1, there is a great protrusion of the adhesive 14 onto the ink supply port 15. Since the surface 31 of the partition 17 facing the opening 32 is located on the outer side (opening side) of an end 30 of the surface 29 of the print element substrate 12 facing the adhesive surface 35 of the partition 17, the adhesive 14 that overflows from the bonding layer is not likely to flow onto the opening side (in the z direction). In contrast, the adhesive 14 is likely to flow to the ink supply port 15 side (in negative z direction), and thus, the adhesive 14 overflowing from the bonding layer greatly protrudes to the ink supply port 15 side. In this case, the protruding adhesive is present as a structure that disturbs the flow of ink in a region close to the ejection port, which might cause unstable supply of ink to the ejection port.

Unlike FIG. 4B-1, the adhesive 14 in FIG. 4C does not protrude greatly onto the ink supply port 15, and the adhesive 14 overflowing from the bonding layer remains around the partition. The partition 18 includes a first portion 33 and a second portion 34. Here, as illustrated in FIG. 4C, the first portion 33 is a portion on more positive side in the z direction with respect to the broken line 20 when the broken line 20 is drawn at a location where the length of the partition 18 in the x direction changes. The second portion 34 is a portion of a region of the partition 18 connected to the first portion 33 and is on the side closer to the print element substrate 12 than the first portion 33, and is a portion on more negative side in the z direction with respect to the broken line 20 illustrated in FIG. 4C. Both the first portion 33 and the second portion 34 are rectangular. As illustrated in FIG. 4C, the second portion 34 is located between extension lines 42 of the two surfaces 31 of the first portion 33 facing the opening 32.

Since the end 30 of the surface 29 of the print element substrate 12 is located on the ink supply port 15 side with respect to the extension line 43 of the surface of the second portion 34 facing the opening 32, the adhesive 14 protrudes onto the opening side (z direction) of the ink supply port 15. Since the partition 18 includes the first portion 33 and the second portion 34, a recess 36 is formed in the partition 18. This allows the adhesive 14 that protrudes onto the opening side (z direction) to be held in the recess 36, and the adhesive 14 would not greatly protrude onto the ink supply port 15. However, since the end 30 of the surface 29 of the print element substrate is located on the opening side (x direction) of the extension line 42 of the surface 31 of the first portion 33 facing the opening, the adhesive 14 cannot flow to the print element substrate 12 side (negative z direction). Therefore, the adhesive surface between the adhesive 14 and the print element substrate 12 is limited to a part of the surface 29 of the print element substrate 12, making it difficult to achieve high adhesive strength.

In contrast, in FIG. 4A-1 according to the present embodiment, the partition 16 includes the first portion 33 and the second portion 34, and in addition to this, the width of the surface 29 of the print element substrate 12 is smaller than the width of the first portion 33 and greater than the width of the second portion 34. Specifically, the end 30 of the surface 29 of the print element substrate is located between an extension line 42 of the surface 31 of the first portion 33 facing the opening 32 and an extension line 43 of a surface 41 of the second portion 34 facing the opening 32 on a side having the extension line 42 of the first portion 33. First, since the partition 16 includes the first portion 33 and the second portion 34, a certain amount of the adhesive 14 is held in the recess 36 as illustrated in FIG. 4C. Similarly to FIG. 4C, it is possible to suppress great protrusion of the adhesive 14 onto the ink supply port 15.

Next, effects of a configuration in which the width of the surface 29 of the print element substrate 12 is smaller than the width of the first portion 33 and greater than the width of the second portion 34 will be described. When the adhesive 14 is crushed by the print element substrate 12 and the recess 36 is filled with the adhesive 14, the partition on more negative side in the z direction with respect to the broken line 20 would have a width substantially the same as the width of the first portion 33 in the x direction as illustrated in FIG. 4A-2. That is, in a case where the recess 36 is filled with the adhesive 14, the relationship between the partition and the print element substrate 12 is the same as the state illustrated in FIG. 4B-1, and thus, the adhesive 14 that cannot be accommodated in the recess 36 would flow to the ink supply port side similarly to the case illustrated in FIG. 4B-1. Fortunately, however, in the present embodiment, since a certain amount of adhesive 14 has already flowed into the recessed portion, it is possible, unlike FIG. 4B-1, to suppress great protrusion of the adhesive 14 onto the ink supply port side. As a result, it is possible to supply a flow of certain amount of the adhesive 14 to the ink supply port side, that is, the side where the ejection port is disposed with respect to the surface 29 of the print element substrate 12, while suppressing the adhesive 14 from protruding greatly to the ink supply port side. Accordingly, the adhesion surface area between the print element substrate 12 and the adhesive 14 is increased, making it possible to ensure sufficient adhesive strength.

As an example, the above-described width of the surface 29 of the print element substrate 12 in the x direction is 0.5 mm, the width of the adhesive surface 35 of the first portion 33 of the partition in the x direction is 0.62 mm, and the width of the second portion 34 in the x direction is 0.4 mm. The heights of the second portion 34 of the partition according to the first embodiment in the z direction and the heights of the second portion 34 according to a second embodiment described below in the z direction are both 0.1 mm. In consideration that the partition 16 has a maximum height of 3.6 mm and the width of the second portion 34 in the x direction is 0.6 mm or more at this height, the support member 13 can be manufactured relatively easily and would be preferable in view of productivity.

In the present disclosure, effects of the present disclosure can be obtained when at least one of the ends 30 of the surface 29 of the print element substrate 12 is located between the extension line 42 of the surface 31 of the first portion 33 facing the opening 32 and the extension line 43 of the surface 41 of the second portion 34 facing the opening 32. Still, as illustrated in FIGS. 4A-0 to 4C, or the like, having the both ends 30 of the surface 29 of the print element substrate 12 located between the extension line 42 and the extension line 43 would be more preferable in view of suppressing protrusion of the adhesive 14 onto the ink supply port and ensuring sufficient adhesive strength.

Example Application Height of Adhesive

The application height 22 of the adhesive 14 applied to the adhesive surface 35 of the partition 16 illustrated in FIG. 4A-0 will be described. In the present embodiment and the second embodiment to be described below, the application height 22 of the adhesive 14 necessary for bonding the print element substrate 12 with the support member 13 is determined as follows. First, the flatness of the adhesive surface 35 of the support member 13 is 0.05 mm, the thickness of the bonding layer necessary for bonding is 0.01 mm or more, and the height for crushing the adhesive 14 with the print element substrate 12 to have sufficient bonding strength is 0.03 mm or more. The variation in the thickness of the print element substrate 12 is 0.02 mm, and the variation of the apparatus in the z direction at attaching the print element substrate 12 to the support member 13 is 0.05 mm. In this case, the minimum required application height 22 of the adhesive 14 would be 0.16 mm in consideration of these conditions. Note that the flatness of the adhesive surface 35 can be improved by manufacturing the support member 13 from ceramic or by shaving and grinding, making it possible to further reduce the required application height 22 of the adhesive 14.

However, even if the required application height 22 is satisfied, in a case where the area of the application surface (adhesive surface 35 of partition 17) to which the adhesive 14 is to be applied as illustrated in FIGS. 4B-0 and 4B-1 is large, the crushed adhesive would spread on the application surface and this might cause a shortage of the adhesive 14 to be supplied to the print element substrate 12 side. Therefore, in the case illustrated in FIGS. 4B-0 and 4B-1, it would be necessary to apply the adhesive 14 having a volume satisfying the required application height 22 of the adhesive 14, or more, to the application surface. Fortunately, however, the region where the crushed adhesive 14 spreads on the application surface would be small in a case where the application surface has a small area as illustrated in FIGS. 4A-0 to 4A-2. Accordingly, the adhesive 14 would flow to the print element substrate 12 side with a small amount of adhesive 14 as long as the adhesive 14 to be applied satisfies the required application height 22. Therefore, according to the present disclosure, the amount of adhesive 14 applied can be reduced.

Furthermore, when the maximum amount of the adhesive 14 is applied to a certain surface, the cross-sectional shape of the adhesive 14 applied with the maximum amount is a semicircle whose diameter is the width of the applied surface. Applying an amount of adhesive more than this would result in forming the angle between the application surface and the outer shape of the adhesive to be an obtuse angle, causing the adhesive to fall off the application surface. In consideration of this, the width of the adhesive surface 35 of the partition is preferably 1.5 times or more the height 22 of the adhesive 14 to be applied. In order to prevent enlargement of the print element substrate 12, the width of the adhesive surface 35 of the partition is preferably three times or less the height 22 of the adhesive 14 to be applied.

Second Example Embodiment

Figure 5:
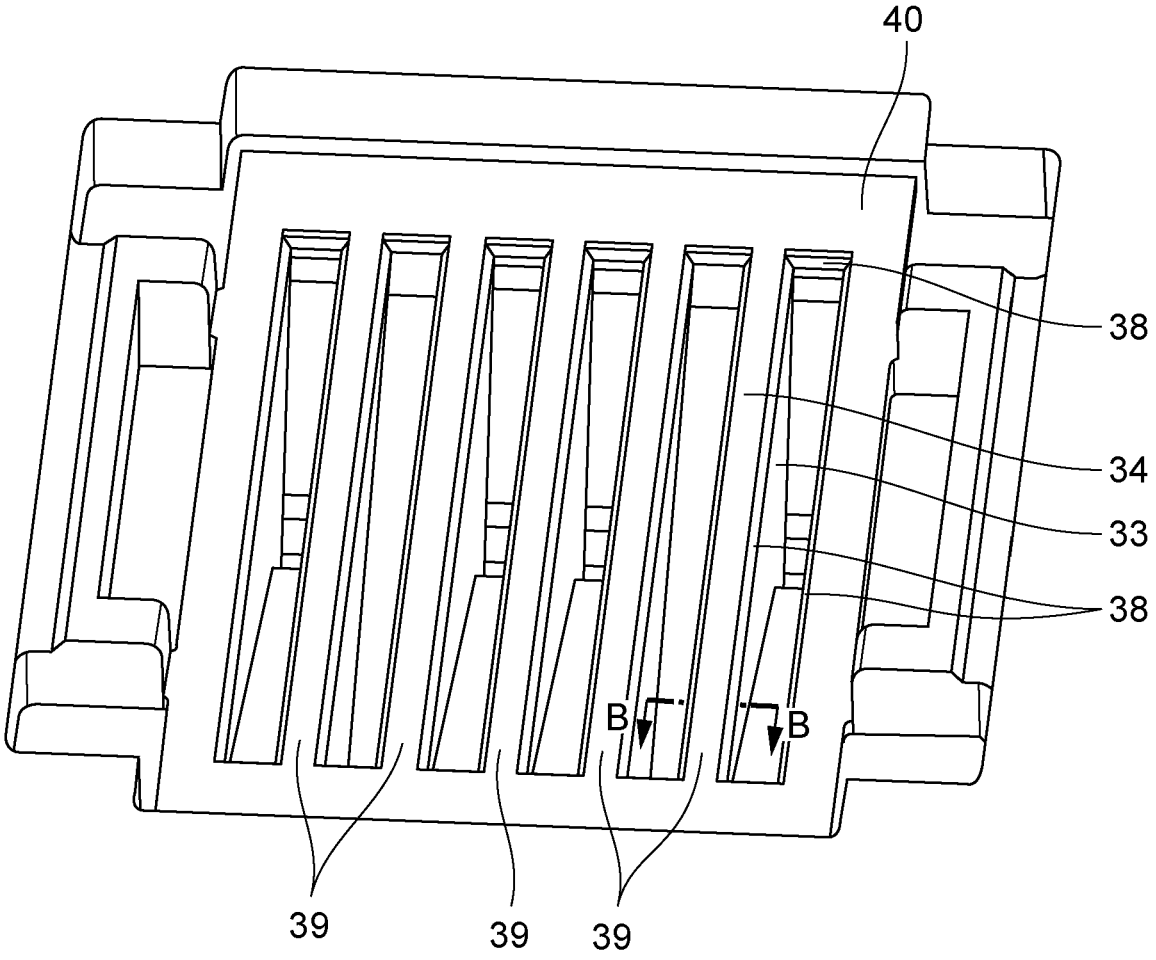
FIG. 5 is a schematic view of a support member according to a second example embodiment.
Figure 6A:
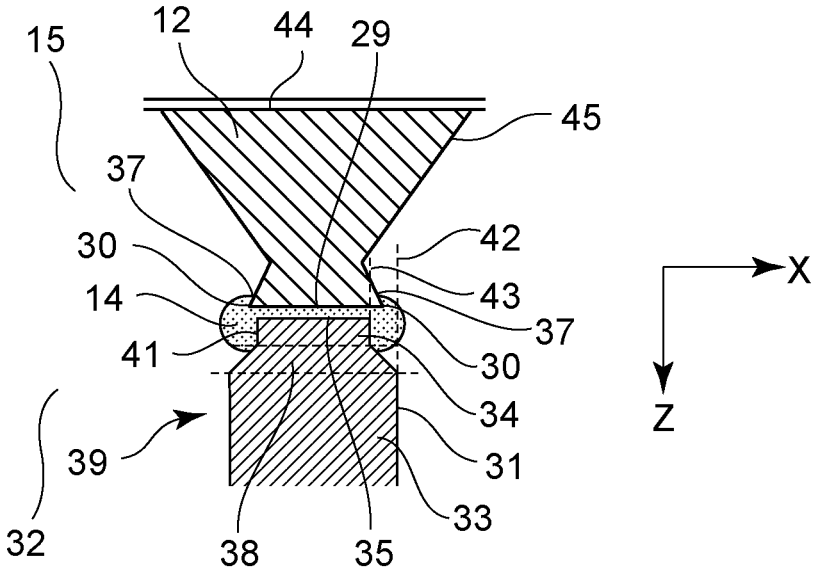
FIGS. 6A and 6B are enlarged views of a bonding portion between a partition of the support member and a print element substrate according to the second example embodiment.
Figure 6B:
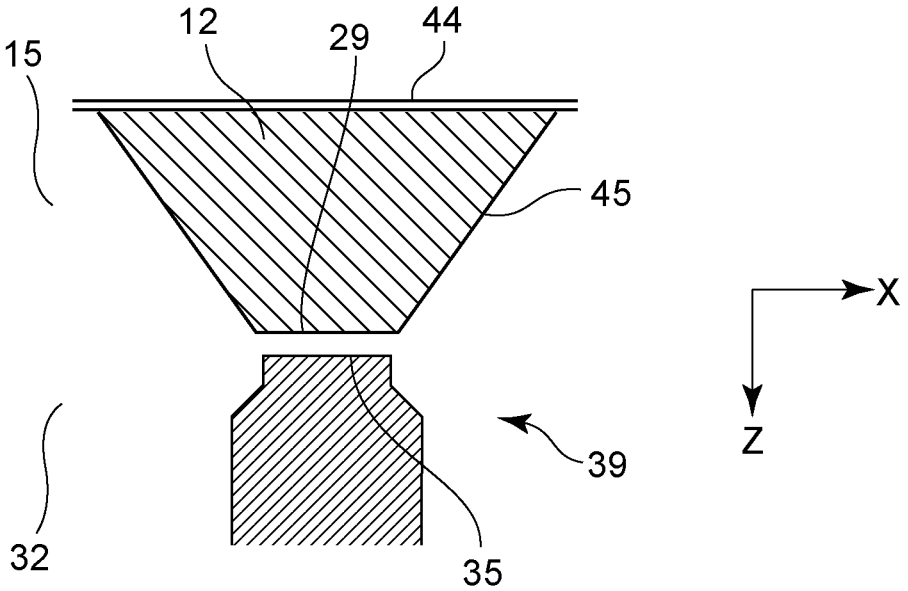

A second embodiment of the present disclosure will be described with reference to FIGS. 5, 6A, and 6B. Note that portions similar to those in the first embodiment will be denoted by the same reference signs and description thereof will be omitted. FIG. 5 is a schematic view illustrating a support member 40 according to the present embodiment. FIG. 6A is a cross-sectional view illustrating a partition 39 in the B-B cross section illustrated in FIG. 5. FIG. 6B is a view illustrating a modification of the print element substrate 12 illustrated in FIG. 6A. The present embodiment is characterized in that the first portion 33 and the second portion 34 of the partition 39 are connected by a third portion 38 including a slope.

The inkjet print head 1 (refer to FIG. 1) is normally used in such a posture that the ejection port surface of the print element substrate 12 is directed downward in the vertical direction. In such a posture, providing the partition 39 with a sloped surface makes it possible to allow the bubbles contained in the ink supply port to float in the z direction illustrated in FIGS. 3A and 3B without being caught in the recess. The presence of bubbles in the vicinity of the ejection port might hinder ejection of the ink from the ejection port. Accordingly, providing the partition 16 with a slope to move the bubbles to the opposite side of the ejection port as in the present embodiment makes it possible to suppress hindrance of ejection of ink from the ejection port.

In general, the support member is manufactured by injection molding a material such as a modified polyphenylene ether resin containing glass fiber (inorganic filler). Providing the partition 16 with a slope makes it possible to fill a support member resin in a mold more easily than in the case of the support member of the first embodiment. Furthermore, since the slope portion has a draft, it is easy to remove the support member from the mold, and the support member can be easily molded.

In a case where a part of the recess 36 of the partition of the first embodiment is not filled with the adhesive 14, the recess 36 of the partition of the first embodiment corresponds to a passage that bends at right angles to the ink flowing through the opening 32. Since there is a passage that bends at a right angle, the flow of ink might be disturbed in the passage bent at a right angle. In contrast, the partition according to the second embodiment illustrated in FIGS. 6A and 6B includes a third portion 38 having a trapezoidal cross section and including a slope. Therefore, even when a part of the recess 36 of the partition is not filled with the adhesive 14, a passage that bends at right angles to the ink flowing through the opening 32 would not be formed, and thus, the flow of ink would not be disturbed so often in the second embodiment. Therefore, from the viewpoint of stabilizing the ink flow, the second embodiment is more preferable than the first embodiment.

In FIG. 6A, the shape of the print element substrate 12 has a "jackknife shape" having a portion where the cross-sectional area of the ink supply port is large and a portion where it is small. The print element substrate 12 can be formed into the shape illustrated in FIGS. 6A and 6B by anisotropic etching, for example. In this case, the angle formed between a slope 45 and a surface 44 illustrated in FIGS. 6A and 6B is about 54.7° for both the print element substrate 12 illustrated in FIG. 6A and the print element substrate 12 illustrated in FIG. 6B. It is assumed that the width of the surface 29 of the print element substrate 12 illustrated in FIG. 6A is the same as the width of the surface 29 of the print element substrate 12 illustrated in FIG. 6B. Moreover, it is assumed that the thickness of the print element substrate 12 in the z direction is also the same in both figures. In this case, since the print element substrate 12 illustrated in FIG. 6A has a "jackknife shape", the width of the surface 44 of the print element substrate 12 is smaller in FIG. 6A. Therefore, for downsizing the print element substrate 12, it is preferable to use the print element substrate 12 having the shape illustrated in FIG. 6A. In FIG. 6A, the maximum width of the ink supply port 15 in the x direction is 0.75 mm.

Furthermore, since the print element substrate 12 has a "jackknife shaped" portion, a portion that fits with the adhesive 14 bonded to the print element substrate 12 is formed. This suppresses removal of the adhesive 14 in the z direction, making it possible to increase the adhesive strength between the adhesive 14 and the print element substrate 12. However, the print element substrate illustrated in FIG. 6B includes no "jackknife shaped" portion, and thus includes no portion that fits with the adhesive. Accordingly, the print element substrate illustrated in FIG. 6A is preferable to the print element substrate illustrated in FIG. 6B from the viewpoint of increasing the adhesive strength.

While the above description has a configuration in which one opening 32 corresponds to one ink supply port 15, the present disclosure may have a configuration in which one opening corresponds to a plurality of ink supply ports. Such a configuration can be suitably used when the arrangement interval of the ink supply ports is narrower.

Third Example Embodiment

Figure 7A:
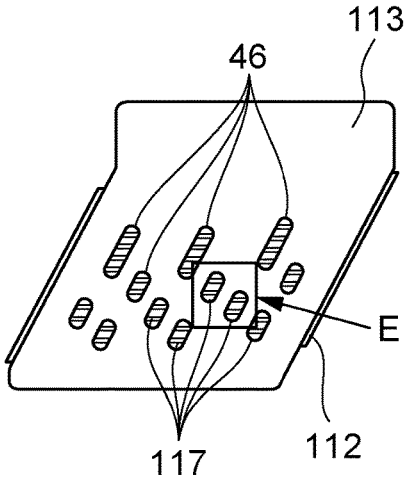
FIGS. 7A to 7E are schematic views illustrating the print element substrate, and the support member according to the second example embodiment.
Figure 7B:
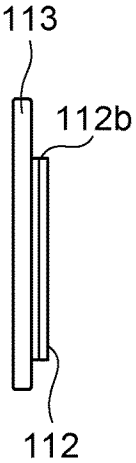
Figure 7C:
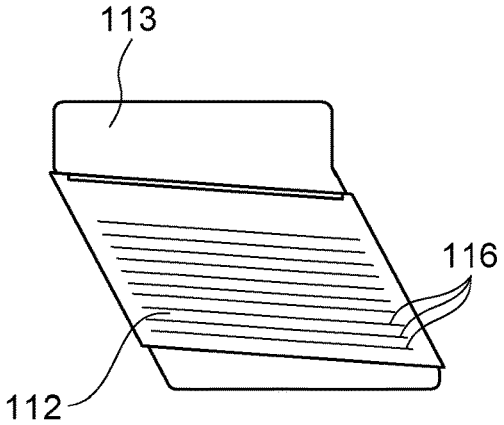
Figure 7D:
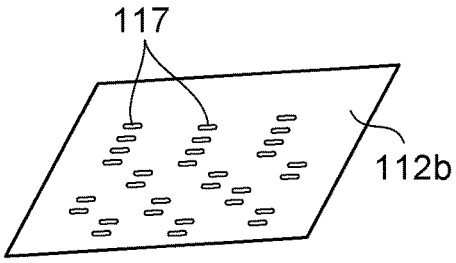
Figure 7E:
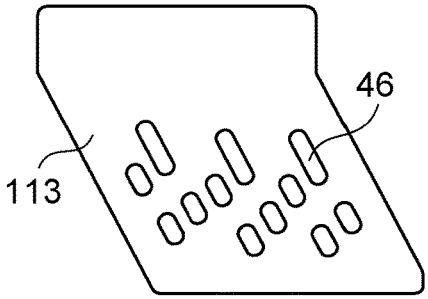

A third embodiment will be described with reference to FIGS. 7A to 11. Note that portions similar to those in the first embodiment will be denoted by the same reference signs and description thereof will be omitted. The present embodiment is characterized in that a plurality of ink supply ports is arranged for one opening. FIGS. 7A to 7E are schematic views illustrating a print element substrate 112, and a support member 113 according to the present embodiment. FIGS. 7A, 7B and 7C are schematic views at a state where the print element substrate 112, and the support member 113 are joined, in which FIG. 7A is a view as seen from the support member 113 side. FIG. 7B is a side view of the print element substrate 112, and the support member 113. FIG. 7C is a view as seen from the ejection port side from which ink is ejected. FIG. 7D is a plan view of the surface of the print element substrate 112 to be joined to the support member 113. FIG. 7E is a plan view of the surface of the support member 113 to be joined to print element substrate 112.

Figure 9:
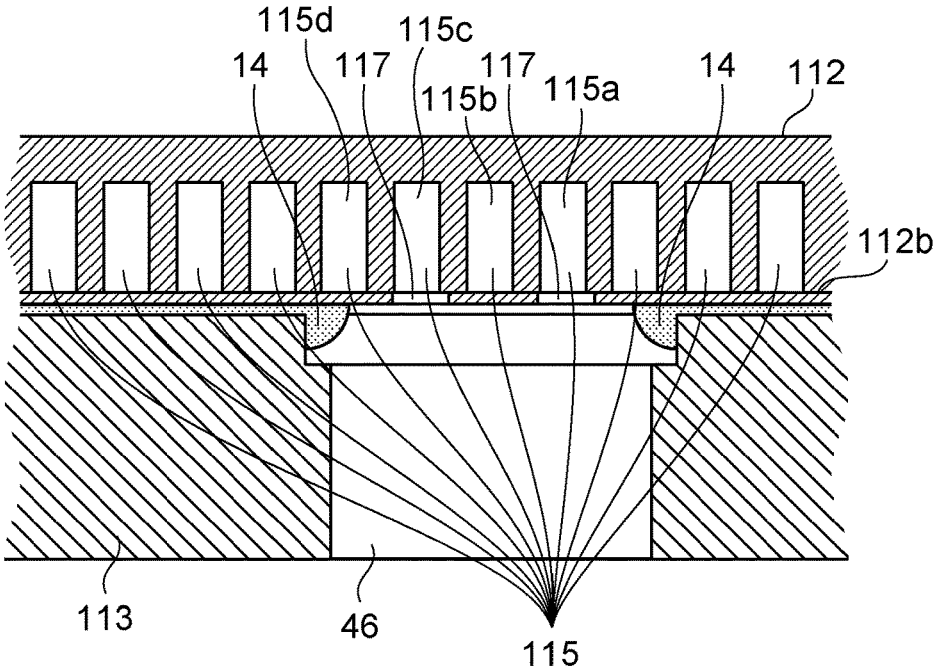
FIG. 9 is a schematic view of an F-F cross section illustrated in FIG. 8.

The plate 112*b* is disposed between the print element substrate 112 and the support member 113 so as to close a certain ink supply port among the plurality of ink supply ports 115 (FIG. 9). Ink of the same color flows through the ink supply ports 115*a* to 115*d*. The ports 115*a* and 115*c* are inflow-side ink supply ports for supplying ink to the ejection ports, while the ports 115*b* and 115*d* are outflow-side ink supply ports for discharging ink from the ejection ports to the outside. The print element substrate 112 includes a plurality of ejection port arrays 116. Each of the ejection port arrays 116 includes the inflow side ink supply port and the outflow side ink supply port as a pair. For example, the 115*a* and 115*b* make a pair, and the 115*c* and 115*d* make a pair. The cross section illustrated in FIG. 9 includes an opening 46 for supplying ink to the inflow side ink supply ports 115*a* and 115*c*. The opening through which ink flows out from the outflow-side ink supply ports 115*b* and 115*d* is provided at different positions with a similar configuration.

Figure 8:
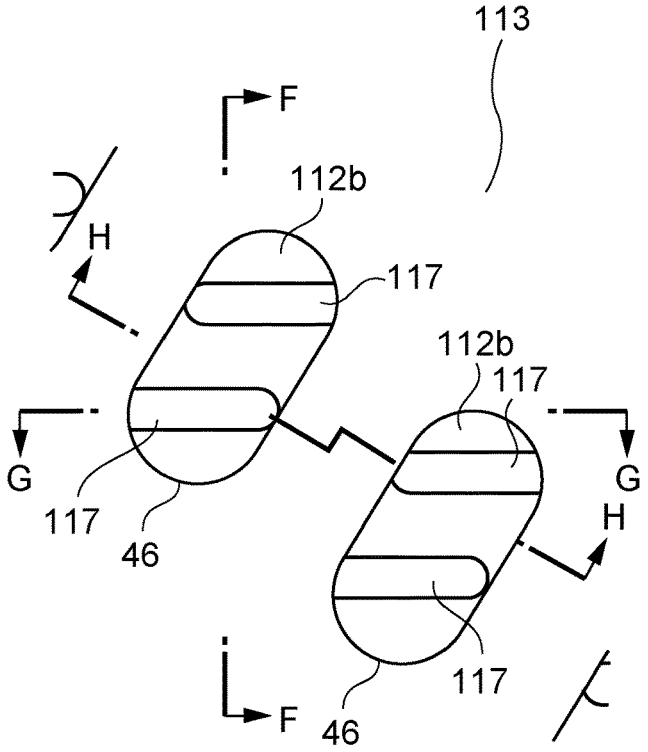
FIG. 8 is an enlarged view of portion E of FIG. 7A.
Figure 10:
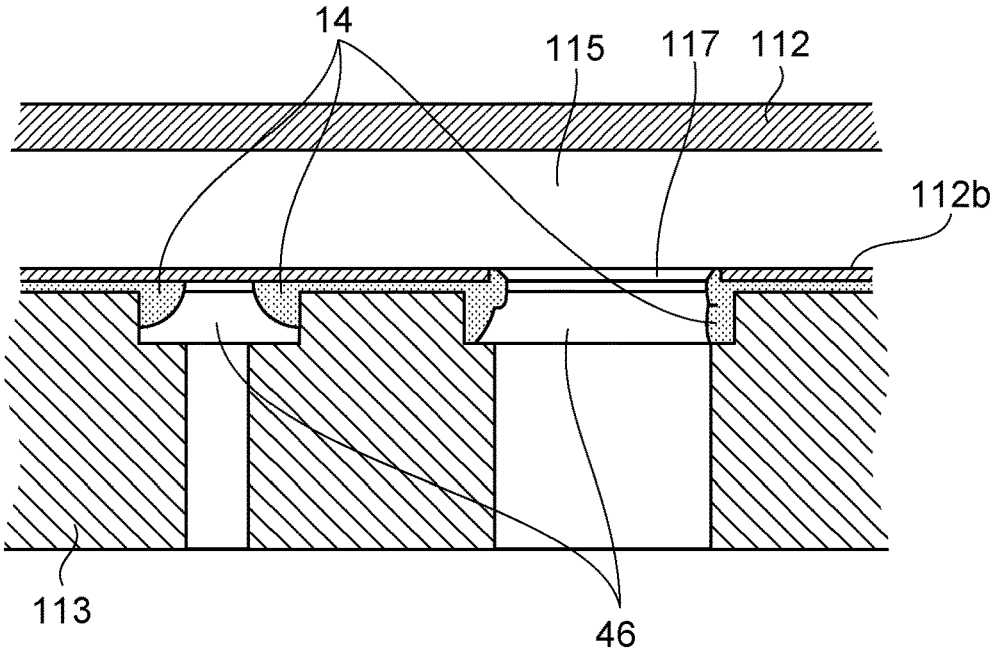
FIG. 10 is a schematic view of a G-G cross section illustrated in FIG. 8.
Figure 11:
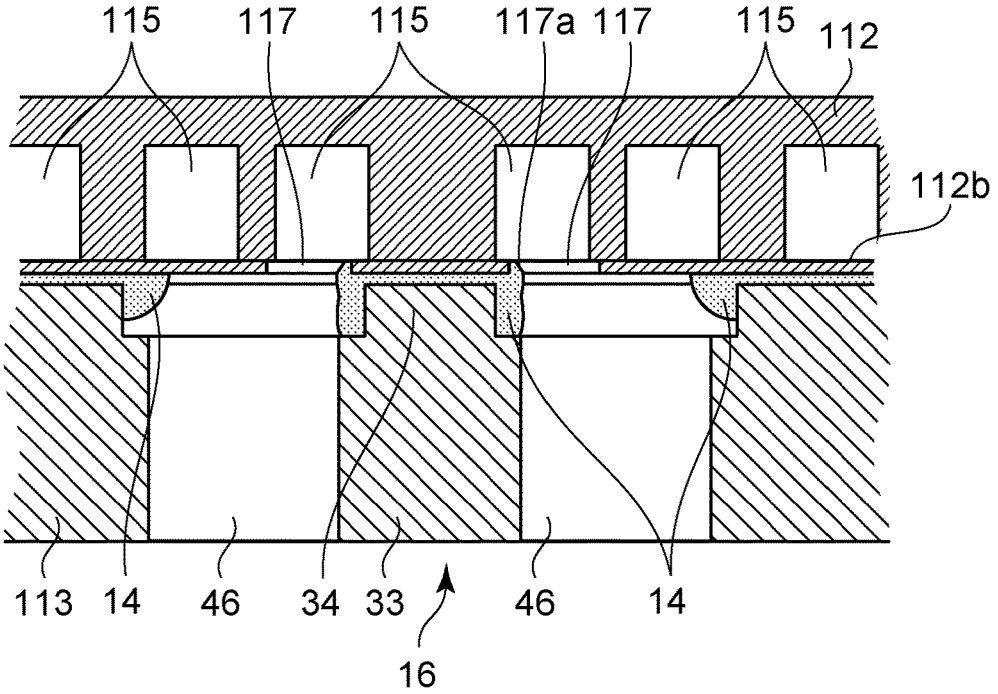
FIG. 11 is a schematic view of an H-H cross section illustrated in FIG. 8.

FIG. 8 is an enlarged view of portion E of FIG. 7A. FIG. 9 is a schematic view of an F-F cross section illustrated in FIG. 8. FIG. 10 is a schematic view of a G-G cross section illustrated in FIG. 8. FIG. 11 is a schematic view of an H-H cross section illustrated in FIG. 8. In the present embodiment, as illustrated in FIG. 9, one opening 46 of the support member 113 is bonded to the plurality of ink supply ports 115 of the print element substrate 112. Furthermore, in the present embodiment, as illustrated in FIG. 11, an end 117*a* of an opening 117 of the plate 112*b* is located between an extension line of the surface of the support member 113 of the first portion 33 of the partition 16 facing the opening 46 and an extension line of the surface of the second portion 34 facing the opening 46. With this configuration, it is possible to ensure sufficient adhesive strength between the print element substrate 112 and the support member 113 while suppressing protrusion of the adhesive 14 onto the ink supply port, similarly to the first embodiment.

According to the present disclosure, it is possible, in the inkjet print head, to ensure sufficient adhesive strength while suppressing protrusion of the adhesive used for fixing the print element substrate and the support member, onto the ink supply port.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-048526, filed Mar. 15, 2019, which is hereby incorporated by reference herein in its entirety

What is claimed is:

1. An inkjet print head comprising:

a print element substrate having an ejection port array of a plurality of ejection ports arranged for ejecting ink and having an ink supply port extending along the ejection port array to supply the ink to the plurality of ejection ports; and a support member having a partition to support the print element substrate and an opening formed between two adjacent partitions for supplying the ink to the ink supply port, wherein the print element substrate and the support member are bonded to each other by adhesive between the print element substrate and the partition, wherein the partition includes a first portion and a second portion connected to the first portion and formed at a position on a side closer to the print element substrate than the first portion, wherein the second portion is located inside individual extension lines of two surfaces of the first portion facing the opening on a cross section orthogonal to a direction in which the ink supply port of the print element substrate extends, and wherein an end of a surface of the print element substrate facing the second portion is located inside an extension line of one surface of the two surfaces of the first portion facing the opening and an extension line of a surface of the second portion facing the opening on a side having the extension line of the one surface of the first portion facing the opening, on a cross section orthogonal to the direction in which the ink supply port of the print element substrate extends.

2. The inkjet print head according to claim 1, wherein both ends of the surface of the print element substrate facing the second portion are located between the extension line of the one surface of the first portion facing the opening and the extension line of the surface of the second portion facing the opening on the side having the extension line of the one surface of the first portion.

3. The inkjet print head according to claim 1, wherein the first portion and the second portion are rectangular on a cross section orthogonal to the direction in which the ink supply port extends.

4. The inkjet print head according to claim 3, wherein the partition is configured such that the first portion and the second portion are connected by a slope on a cross section orthogonal to the direction in which the ink supply port extends.

5. The inkjet print head according to claim 3, wherein the partition further includes a trapezoidal third portion disposed between the first portion and the second portion on a cross section orthogonal to the direction in which the ink supply port extends, and wherein the second portion is connected to the first portion via the trapezoidal third portion.

6. The inkjet print head according to claim 1, wherein the adhesive is located on a side where the ejection port array is disposed with respect to the surface of the print element substrate.

7. The inkjet print head according to claim 1, wherein the print element substrate has a plurality of the ink supply ports.

8. The inkjet print head according to claim 1, wherein the ink supply port of the print element substrate includes a portion having a cross-sectional area that increases in a direction of ink ejection and a portion having a cross-sectional area that decreases in the direction of ink ejection, on a cross section orthogonal to the direction in which the ink supply port extends.

9. The inkjet print head according to claim 1, wherein the support member includes a resin.

10. The inkjet print head according to claim 9, wherein the support member includes a modified polyphenylene ether resin and an inorganic filler.

11. The inkjet print head according to claim 1, wherein the support member includes ceramic.

12. The inkjet print head according to claim 1, wherein one opening is provided to correspond to one ink supply port.

13. The inkjet print head according to claim 1, wherein one opening is provided to correspond to a plurality of the ink supply ports.

* * * * *